United States Patent [19]

Koch

[11] 3,998,169

[45] Dec. 21, 1976

[54] KNOCK-DOWN PALLET STACKER

[75] Inventor: Robert B. Koch, Chagrin Falls, Ohio

[73] Assignee: Bliss & Laughlin Industries, Incorporated, Cleveland, Ohio

[22] Filed: Sept. 4, 1975

[21] Appl. No.: 610,118

[52] U.S. Cl. ..... 108/53.5

[51] Int. Cl.[2] ..... B65D 19/40

[58] Field of Search ..... 108/51, 53, 55, 56; 211/177; 292/256.69; 214/10.5 R

[56] References Cited

UNITED STATES PATENTS

| | | | |
|---|---|---|---|
| 1,994,374 | 3/1935 | Wackman | 292/256.69 |
| 2,728,544 | 12/1955 | Ayre et al. | 108/53 |
| 2,905,496 | 9/1959 | Hornsby | 292/256.69 |
| 2,926,792 | 3/1960 | Seiz | 108/53 |
| 3,091,195 | 5/1963 | Kenyon et al. | 108/53 |
| 3,476,060 | 11/1969 | Sjoblom | 108/55 |
| R26,481 | 10/1968 | Evans | 108/53 |

FOREIGN PATENTS OR APPLICATIONS

| | | | |
|---|---|---|---|
| 211,736 | 3/1960 | Austria | 108/53 |
| 108,908 | 2/1968 | Denmark | 108/53 |
| 163,980 | 7/1958 | Sweden | 108/53 |
| 481,801 | 1/1970 | Switzerland | 292/256.69 |
| 1,385,431 | 2/1975 | United Kingdom | 108/55 |

*Primary Examiner*—Roy D. Frazier
*Assistant Examiner*—William E. Lyddane
*Attorney, Agent, or Firm*—Baldwin, Egan, Walling & Fetzer

[57] ABSTRACT

A knock-down device is presented for use in stacking wooden pallets, one above the other, in a manner to protect the wooden pallet against much of the damage usually encountered, and in a manner wherein the load from each pallet above the lowermost is transmitted through aligned corner posts to the supporting floor independently of the pallets. The completed device is usually composed of two identical complexes, each of which includes two adjacent sides of the stacker device arranged in such a manner that two generally L-shape structures, as seen in plan view, are secured together to form a complete rectangle in plan.

5 Claims, 10 Drawing Figures

KNOCK-DOWN PALLET STACKER

BACKGROUND OF THE INVENTION

Wooden pallets of a generally standard construction are commonly used to support loads for handling and storage of parts. During such use the pallets are handled, usually roughly, whereby the pallets are subject to usual damage. Also, where such pallets are stacked one above the other, the loads from the upper pallets in a stack are transmitted, commonly at least partly through the pallets lower in the stack so that the load transmitting portions of the pallets are damaged. The present invention is to protect the wooden pallets from such damaging action insofar as possible.

An object of this invention is to provide a generally rectangular stacking device which can be easily clamped at its lower edge to a wooden pallet and which will provide four corner posts connected near the bottom on two opposite sides by two lower cross pieces which fit snugly over the ends of the parallel boards forming the top of the pallet, and which are connected at the top by four upper cross pieces. One pair of these upper cross pieces is rigidly connected between the corner posts, on one side of the rectangle, and each has a lower flange rigidly connected to an upwardly extending flange on its outer edge, this last named flange being flared outwardly to guide an upper similar device into stacking position. The other two sides of the rectangle are connected by rigid beams which are connected by a pivot pin at one end and so arranged that this last named upper cross piece can be oscillated about the pivot pin to a position closely beneath and aligned with one of the first named upper cross pieces so as to provide one of the two complexes which in this position of the parts is substantially a flat rectangle. To make a complete stacking device, two of these complexes are secured together by a pin or bolt securing the opposite end of the pivoted cross piece of the first member to a corner post of the second complex.

Other objects and advantages of the invention will be apparent from the accompanying drawings and description and the essential features thereof will be set forth in the appended claims.

In the drawings,

FIG. 9 is an enlarged view taken at the lower right-hand side of FIG. 2 showing in dot-dash lines movement of the parts when extended to permit assembly of the parts; while

Figure 1:
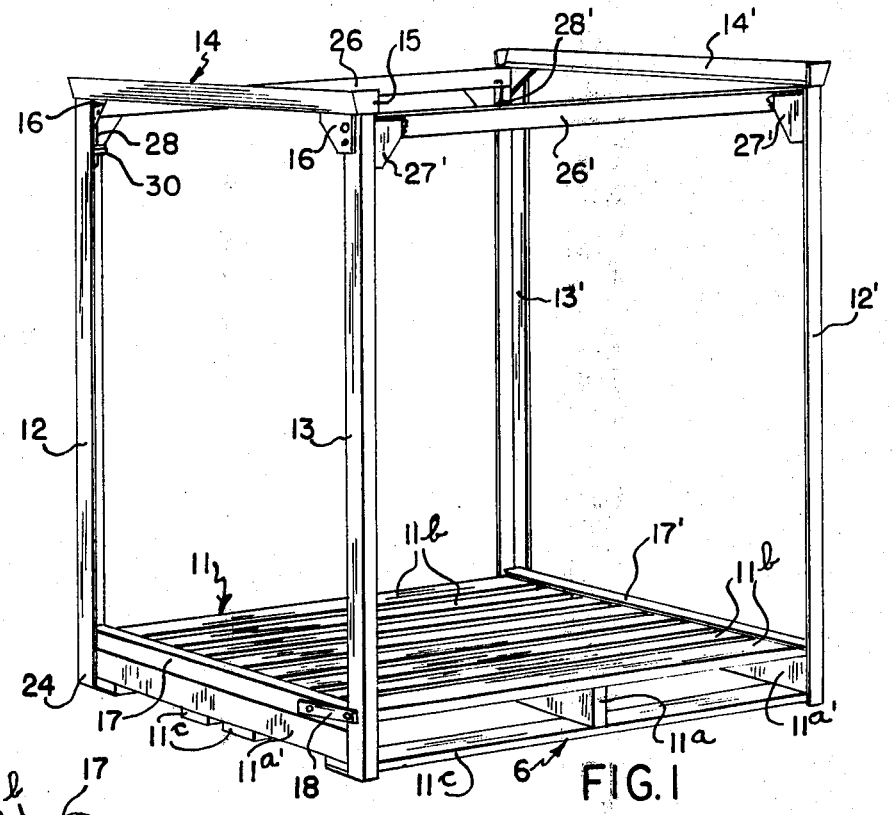
FIG. 1 is a perspective view of the completed pallet stacker device of this invention.
Figure 6:
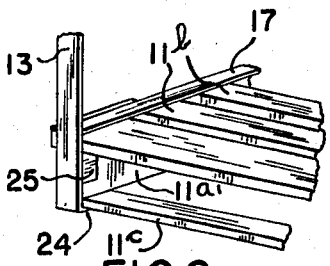
FIG. 6 is a fragmental sectional view taken in the direction of the arrow 6 in FIG. 1.
Figure 7:
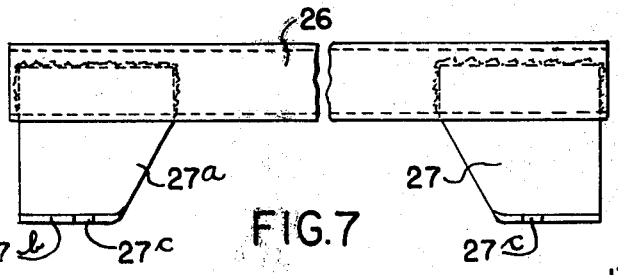
FIG. 7 is an elevational view of one of the upper cross pieces taken along the line 7—7 in FIG. 3

A wooden pallet of the type intended for use with this stacking device is clearly seen in FIGS. 1 and 6. This pallet consists of a plurality of parallel stringers 11*a* of which two are close to marginal edges of the pallet as indicated at 11*a*′. These stringers are rigidly connected by boards 11*b*, on the upper surface of the pallet, rigidly secured by nails or screws crosswise of the stringers 11*a* and 119′. The stringers are also rigidly connected along the bottom surface by other boards 11*c* connected rigidly to the stringers. This completes the wooden pallet 11.

Since the complete stacker device involves the assembly of two identical complexes, one only of these complexes will be described in detail and the identical parts on the other complex will be given the same reference character with a prime suffix.

Figure 2:
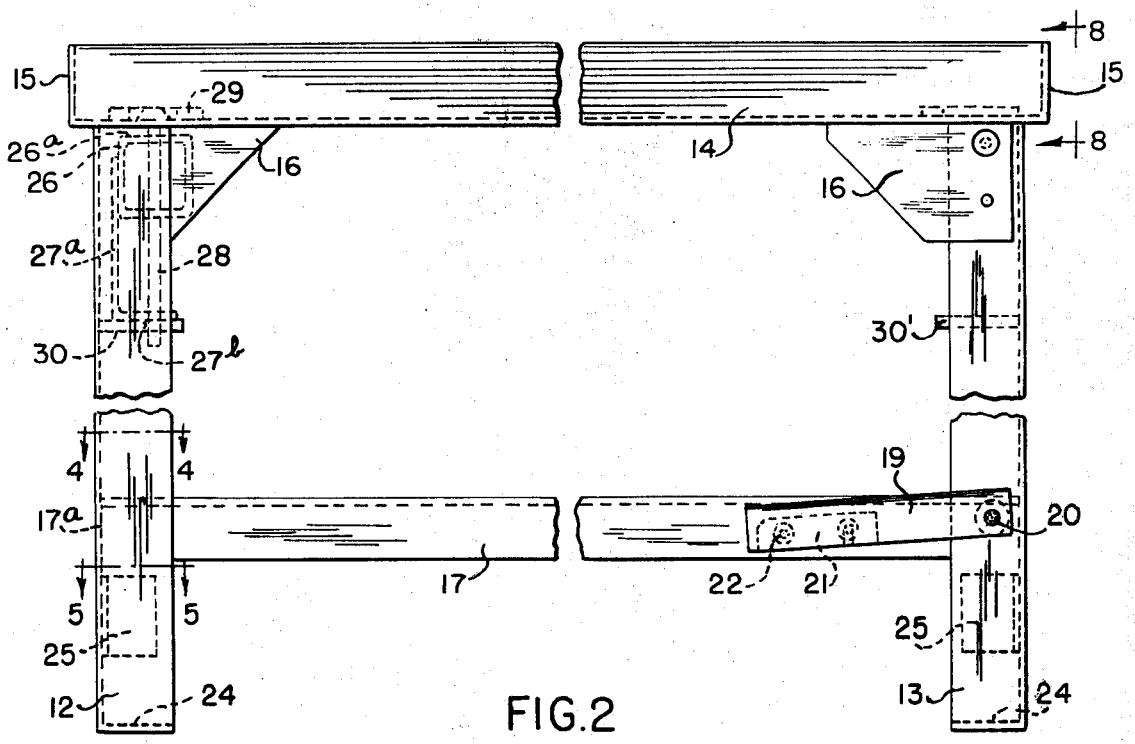
FIG. 2 is an elevational view, enlarged, taken along the left-hand side of FIG. 1.

Referring to FIGS. 1 and 2, four corner posts 12, 13, 12′ and 13′ are provided in vertical position at the four corners of the rectangular pallet. Preferably these four corner posts are steel angles opening inwardly. The tops of the corner posts 12 and 13 are rigidly connected by an upper cross piece 14 which, as clearly seen in FIG. 8, comprises a bottom flange 14*a* integral with an upstanding side flange 14*b*, this structure extending from end to end of the cross piece 14 and being closed at opposite ends by end plates 15. It will be noted in FIG. 8 that the upstanding flange 14*b* is inclined slightly outwardly and upwardly so as to guide an upper stacker unit into the proper position directly above the unit here described when two units are stacked. All of the parts of the cross piece 14 are welded together into a rigid unit. They are also welded to the tops of the posts 12 and 13. Strengthening gussets are seen at 16.

A lower cross piece 17, below and parallel to the cross piece 14, is rigidly connected at one end 17*a* to the corner post 12 as by welding and which is provided at the opposite end with a permanently attached extendable and collapsible connection to the associated post 13. This structure is shown at 18 and is clearly shown in FIGS. 9 and 10 which will presently be described.

Figure 9:
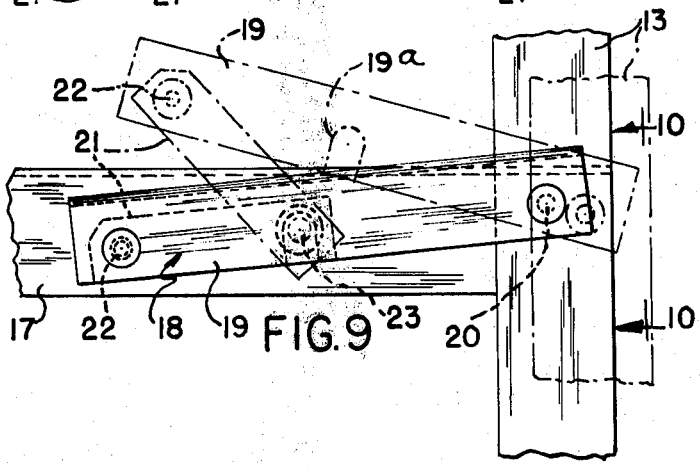
Figure 10:
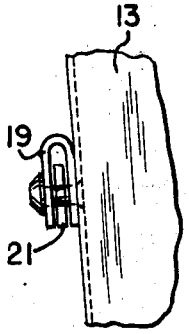
FIG. 10 is an end elevational view taken along the line 10—10 of FIG. 9

The extendable connection 18 comprises a pivot bar 19 which is preferably U-shape opening downwardly as clearly seen in FIG. 10. This is permanently connected to the post 13 by a rivet 20 which is loose enough to provide pivoting of the member 19 about it. A link bar 21 is pivotally connected at 22 to the bar 19 toward the outer free end thereof and pivotally connected to the cross piece 17 at 23. The connection 18 is shown partially extended in dot-dash lines in FIG. 9 which permits the post 13 to be moved toward the right as viewed in the figure to permit the posts 12 and 13 to be assembled on the wooden pallet in the position shown in FIG. 1. After all of the parts are in the proper position, then connection 18 is collapsed to the full line position shown in FIG. 9 which holds the corner post 13 tightly against the lower cross piece 17 and holds the cross piece 17 firmly against the otherwise exposed ends of the boards 11*b* as clearly seen in FIG. 1. The connection 18 provides the only connection between the corner post 13 and the cross piece 17. The member 19 is cut out at 19*a* to permit the parts 19 and 21 to move from the extended position to the collapsed position as shown in FIG. 9. It should be noted that the cross piece 17 is at a height to rest approximately on the upper surfaces of the boards 11*b*, and that the member 17 is a steel angle iron opening inwardly.

It should be noted that each of the four corner posts has a bottom plate 24 rigidly secured at its lower end in position to fit between the boards 11*c* on the lower surfaces of the stringers 11*a*′ and the supporting floor.

Figure 5:
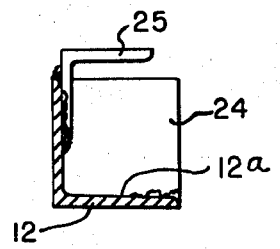

There is also a tab 25 rigidly secured near the bottom of each corner post and spaced to rest firmly against the inner vertical face of each marginal stringer 11*a'* between the boards 11*b* on the upper side of the pallet stringers and the boards 11*c* on the lower sides of the stringers. This is clearly seen in FIG. 6 as well as in FIGS. 1 and 5. Referring to FIG. 5, it will be seen that the stringer 11*a'* fits between the tab 25 and the arm 12*a* of the angle iron which froms the corner post 12. This holds the corner posts firmly at the four corners of the rectangular pallet.

A rigid upper cross piece 26, as seen in FIGS. 1, 2, 3 and 7, is here shown as a hollow tube of substantially square cross section. Rigidly attached at opposite ends of the cross piece 26 are pivot seats 27 which have vertical flanges 27*a* welded to the tubular member 26 and having horizontal flanges 27*b* which are perforated at 27*c* to permit the insertion of a pivot pin 28 which is also supported at its upper end in a suitable opening in plate 29, and at its lower end in a suitable opening in plate 30 which is welded to post 12.

Figure 8:
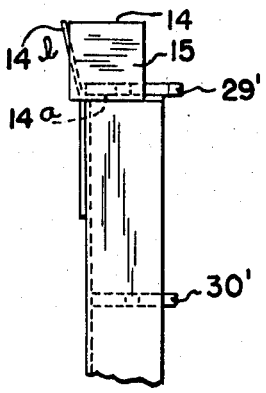
FIG. 8 is a fragmental elevational view taken along the line 8—8 of FIG. 2.
Figure 3:
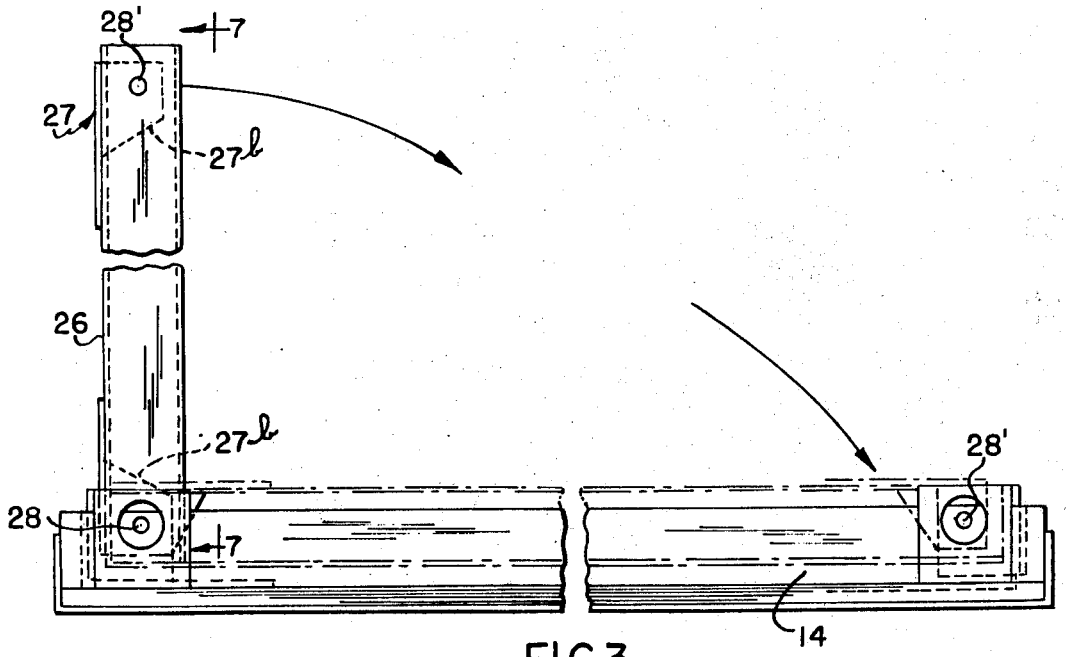
FIG. 3 is a top plan view of the device of FIG. 2 showing one of the pivoted upper cross pieces which lies at the rear of the view shown in FIG. 1.
Figure 4:
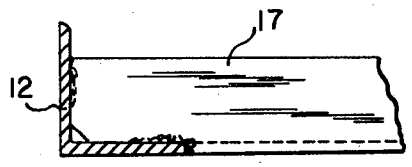
FIGS. 4 and 5 are fragmental sectional views taken along similarly numbered lines in FIG. 2.

When two identical structural components as shown in FIGS. 2 and 3 are secured together to form a complete stacker device, then a pin or bolt is passed through the opening 27*c* at the end of the cross piece 26 opposite the pivot pin 28 and this connecting member passes through openings in plates 29' and 30' as seen in FIG. 8, as well as through the opening 27*c*. This holds the two halves of the device together.

Referring to FIGS. 2 and 3, it will be seen that the top surface of the cross piece 26, at 26*a*, lies below the lower level of the upper cross piece 14 so that when the two halves of the complete device are separated, the cross piece 26 may be oscillated as indicated by the arrow in FIG. 3 from a position at right angles to the member 14 to a nested position directly below the member 14 so that all of the parts of FIGS. 2 and 3 can be collapsed to a generally planar position as shown in the dot-dash lines at the lower edge of FIG. 3. In this position of the parts, the novel structure herein described takes very little space for storage or shipment.

In use, two complexes, each like that shown in FIGS. 2 and 3, are assembled with the member 14' parallel and opposite to the member 14 and with the member 26' parallel to and opposite the member 26 and parts are then connected by a bolt or pin at the point marked 28' in FIG. 3. When so used, the corner posts and the four corner plates 24 and the four tabs 25 and the lower cross pieces 17 protect the wooden pallet 11 against damage and the load from each pallet, above the lowermost one, is transmitted through the aligned corner posts to the supporting floor independently of the pallets.

What is claimed is:

1. A demountable metal stacking device adaptable for use with a standard rectangular wood pallet consisting of a pluraliity of parallel stringers of uniform depth, two of which are close to marginal edges of said pallet and rigidly connected by boards secured to the upper and lower surfaces of said stringers; said device comprising four parallel vertical corner posts, one at each corner of said rectangle; two lower cross pieces secured one between each two posts respectively on opposite sides of said rectangle at a height to rest approximately on said boards on the upper surfaces of said stringer and holding the associated posts firmly against opposite ends of said stringer; a bottom plate rigidly secured to each of said posts in position to fit between said boards on the lower surfaces of said stringers and a supporting floor; said plates having an area at least covering the major portion of the sectional area of each post; a tab rigidly secured near the bottom of each post spaced to rest firmly against the inner vertical face of each marginal between said boards on said upper and lower stringer surfaces; four upper cross pieces secured by connections between the upper ends of said posts along the four sides of said rectangle; two of said connections being demountable pins; on end of each of said lower cross pieces being secured by a permanently attached extendable and collapsible connection to an associated post which is extendable to permit said bottom plate and tab to pass over said marginal stringer and is collapsible to hold said corner post and connected lower cross pieces closely assembled; the opposite end of each lower cross piece being welded to its associated post; and upwardly extending guide means flared outwardly and rigidly secured to some of said upper cross pieces and positioned to guide an upper device relative to a lower device when two of said devices are stacked so that each of said posts of an upper device rests vertically above a respective post of said lower device; whereby said posts and said bottom plates and said tabs and said lower cross pieces provide protection of said wood pallets against damage and the load from each pallet above the lowermost is transmitted through said aligned posts to the supporting floor independently of said pallets.

2. A demountable metal stacking device as defined in claim 1, wherein a first pair of said upper cross pieces are parallel and at a level above the other pair of said upper cross pieces; said first named two cross pieces being angles having an upwardly extending flange on the outside and an inwardly extending flange at the bottom edge thereof; and said guide means is provided by flaring said upwardly extending flange upward and outward.

3. A demountable metal stacking device as defined in claim 2, wherein a pivot pin connection is provided between one end of one of said first pair of said upper cross pieces and the adjacent end of one of said other pairs of upper cross pieces; the opposite end of said one of said other pair of upper cross pieces having a removable fastening connection with the other of said other pair of upper cross pieces; whereby said removable fastening may be released and said one of said other pair of upper cross pieces may be pivoted around said pivot pin connection to a position beneath and parallel to said one of said first pair of upper cross pieces.

4. A demountable metal stacking device as defined in claim 3, wherein said corner posts are angles having one leg extending down each side of said rectangle, and said tab is welded to one of said legs parallel to the other of said legs.

5. A demountable metal stacking device as defined in claim 1, wherein said extendable and collapsible connection consists of a longer arm and a shorter arm pivotally connected near one end of each arm; said longer arm having a pivotal connection at its opposite end with said associated corner post; said shorter arm having a pivot pin connection at its opposite end with its associated lower cross piece; and there being a recess in said longer arm opening downwardly and of a size to snugly engage said pivot pin when said arms are in aligned position; whereby said arms may be oscillated in one direction about said pivot pin connection to cause said associated post to move outwardly away from the connected associated lower cross piece; and then said arms may be oscillated in the opposite direction until said arms are mutually aligned with said pivot pin in said recess holding said associated corner post tight against said associated lower cross piece.

* * * * *